US005598891A

United States Patent [19]

Snider et al.

[11] Patent Number: 5,598,891

[45] Date of Patent: Feb. 4, 1997

[54] APPARATUS AND METHOD FOR PERFORATING AND FRACTURING

[75] Inventors: Philip M. Snider, Houston; David S. Wesson, Waxahachie, both of Tex.

[73] Assignee: Marathon Oil Company, Findlay, Ohio

[21] Appl. No.: 489,309

[22] Filed: Jun. 9, 1995

Related U.S. Application Data

[63] Continuation-in-part of Ser. No. 286,154, Aug. 4, 1994, abandoned.

[51] Int. Cl.[6] ..... E21B 43/117; E21B 43/26; E21B 43/267

[52] U.S. Cl. ..... 166/308; 166/55.1; 166/297; 175/4.6

[58] Field of Search ..... 166/55, 55.1, 297, 166/308; 175/4.6, 4.5, 4.54, 4.58

[56] References Cited

U.S. PATENT DOCUMENTS

| | | | |
|---|---|---|---|
| Re. 21,356 | 2/1940 | Pitzer . | |
| 2,591,807 | 4/1952 | Greene . | |
| 3,170,517 | 2/1965 | Graham et al. . | |
| 3,182,723 | 5/1965 | Layne, Sr. . | |
| 3,391,739 | 7/1968 | Venghiattis . | |
| 3,415,321 | 12/1968 | Venghiattis . | |
| 3,713,487 | 1/1973 | Lozanski | 166/280 |
| 4,160,412 | 7/1979 | Snyer et al. | 166/299 X |
| 4,537,255 | 8/1985 | Regalbuto et al. | 166/299 X |
| 4,579,695 | 4/1986 | Muller et al. | 264/3 E |
| 4,678,037 | 7/1987 | Smith | 166/299 |
| 4,790,385 | 12/1988 | McClure et al. | 166/299 |
| 5,318,126 | 6/1994 | Edwards et al. | 166/299 X |

*Primary Examiner*—Stephen J. Novosad
*Attorney, Agent, or Firm*—Jack L. Hummel; Jack E. Ebel

[57] ABSTRACT

An apparatus and method for perforating and fracturing subterranean formations to enhance fluid production. At least one unlined punch charge is loaded into at least one punch charge carrier, and the void spaces in the punch charge carrier are filled with sand. The punch charge carrier is assembled with at least one perforating charge carrier, loaded with at least one perforating charge, and a means for detonation. The assembly is positioned in a well containing a pressurized fluid adjacent the interval to be perforated and/or fractured, and the charges are detonated. The one or more punch charges create one or more apertures in the punch charge carrier, allowing sand to enter the well and be carried by the fluid in the well into the perforations and/or fractures created by the perforating charges and the pressurized fluid. The sand scours and/or props the perforations and/or fractures.

65 Claims, 6 Drawing Sheets

APPARATUS AND METHOD FOR PERFORATING AND FRACTURING

CROSS REFERENCE TO THE RELATED APPLICATION

This application is a continuation-in-part of application Ser. No. 08/286,154, filed on Aug. 4, 1994, now abandoned.

BACKGROUND OF THE INVENTION

1. Field of Invention

This invention relates generally to an apparatus and method for enhancing productivity from a subterranean hydrocarbon bearing formation, and in particular to an apparatus and method for improving the productivity of hydrocarbons produced from a subterranean formation through perforations in a well penetrating the formation.

2. Description of Related Art

In completing a well for producing fluids from a subterranean formation, it is common to install a casing, cement the casing to the well bore face, and then perforate the casing and cement by detonating shaped explosive charges. The perforations thus formed extend through the casing and the cement a short distance into the formation. In some formations, it is desirable to conduct the perforating operations with the pressure in the well overbalanced with respect to the formation pressure. Under overbalanced conditions, the well pressure exceeds the pressure at which the formation will fracture, and hydraulic fracturing occurs in the vicinity of the perforations. The perforations may penetrate several inches into the formation, and the fracture network may extend several feet into the formation. Thus, an enlarged conduit can be created for fluid flow between the formation and the well, and well productivity may be significantly increased by deliberately inducing fractures at the perforations.

When the perforating process is complete, the pressure within the well is allowed to decrease to the desired operating pressure for fluid production or injection. As the pressure decreases, the newly created fractures tend to close under the overburden pressure. One approach to ensuring that fractures and perforations remain open conduits for fluids flowing from the formation into to the well or from the well into the formation is to inject particulate material into the perforations to prop the fractures open. The proppant can be emplaced either simultaneously with formation of the perforations or at a later time. For example, the lower portion of the wellbore can be filled with a sand slurry prior to perforation. The sand is subsequently driven into the perforations and fractures by the pressured fluid in the wellbore during conventional overbalanced perforating operations. In addition to propping the induced fractures, the sand may also scour the surface of the perforations and/or the fractures, thereby enlarging the conduits created for enhanced fluid flow.

Problems encountered with prior art fracturing methods include (1) difficulty in maintaining adequate fluid pressure to enable the proppant to enter the fracture and (2) the need to use relatively large quantities of liquid and proppant. One solution to the first problem is to mount a container, or dump bailer, of sand above a perforating gun in a well with overbalanced conditions. Simultaneously with detonation of the perforating charges, the sand is released into the well by rupturing the bottom of the dump bailer and carried into the perforations by the pressured liquid. Another method emplaces the sand after perforation by applying mechanical or explosive pressure to a combination of particulate matter and liquid in the wellbore adjacent the perforations.

Prior art methods of propping fractures in conjunction with the perforating operation have generally utilized wireline devices or assemblies which are lowered into the well on an electrical cable in communication with instrumentation at the surface. The limited strength of the wireline limits the length of the perforation assembly that can be lowered, thereby also limiting the length of the interval in the well that can be perforated at one time. Decreased operating costs could be achieved if longer intervals could be perforated in one trip into well. Fewer trips into the well would also decrease the risk of accidents due to well blowouts during high pressure operations and less handling of explosives for perforating. Further, it is often desirable to perforate longer intervals in horizontal wells than are commonly encountered in vertical wells.

The use of wireline devices also limits the weight of the perforating string and the pressure which can be applied to the zone being perforated. Because packers cannot be used to isolate zones within the well in conjunction with a wireline, the entire well must be subjected to the pressure required for the perforating/fracturing operation. Thus, the pressure must be limited to a pressure which will not damage the weakest part of the well. For example, the high pressure required to fracture an interval may damage another, previously completed, interval in the well. Further, a relatively large quantity of liquid and gas may be required to pressurize the entire well, increasing the cost of the operation.

Wireline conveyance of perforating devices is also unsatisfactory when perforating high-angle and horizontal wells. It is well known in the art that most downhole tools, including perforating devices, cannot be positioned properly using wirelines in high-angle sections of wells. A more rigid conveyance means, such as tubing, must be utilized.

Thus, it is an object of the present invention to enable improved perforation, fracturing, and propping of longer intervals of a subterranean well and formation in a single operation, using small quantities of fluid and proppant.

It is also an object of the present invention to confine pressurized fluid to an isolated zone in a well during perforation.

It is an additional object of the present invention to confine higher fluid pressure to an isolated zone in a well during perforation.

It is yet another object of the present invention to provide a means of perforating and fracturing intervals in high-angle and horizontal wells, utilizing tubing-conveyed perforating equipment.

SUMMARY OF THE INVENTION

To achieve the foregoing and other objects, and in accordance with the purposes of the present invention, as embodied and broadly described herein, one characterization of the present invention comprises an unlined punch charge mounted in a charge carrier for use inside a cased well which penetrates a subterranean formation. The charge comprises a case containing a shaped explosive, and optionally a coating over the shaped explosive. The explosive is capable, upon detonation, of creating an aperture in a wall of the charge carrier without creating an aperture in the well casing.

Another characterization of the present invention comprises an apparatus for introducing particulate material into a cased well penetrating a subterranean formation. The apparatus comprises at least one unlined punch charge carrier having void spaces. Filling the void spaces in the at least one carrier is a means for scouring and propping at least one fracture in the subterranean formation. At least one punch charge is mounted in the at least one carrier, and a means is provided for detonating the at least one charge. The punch charge comprises a case containing a shaped explosive and, optionally, a coating over the shaped explosive. The charge is capable of creating an aperture in the punch charge carrier without creating an aperture in the well casing.

Yet another characterization of the present invention comprises an apparatus for perforating and fracturing an interval in a cased well penetrating a subterranean formation. The apparatus comprises a means for placing the apparatus in a well adjacent the interval to be perforated and at least one unlined punch charge carrier having void spaces. Filling the void spaces in the at least one punch charge carrier is a means for scouring and propping at least one fracture in the subterranean formation. At least one punch charge is mounted in the at least one charge carrier. The apparatus also comprises at least one perforating charge carrier, with at least one perforating explosive charge mounted in the at least one perforating charge carrier. The at least one punch charge carrier and the at least one perforating charge carrier are rigidly connected by at least one rigid mechanical connector, thereby forming a rigid string of charge carriers. A means is provided for detonating the at least one unlined punch charge and the at least one perforating charge. The apparatus additionally comprises a means for providing fluid at an overbalanced pressure in the well adjacent the interval.

A further characterization of the present invention is a method for creating fractures in an interval of a subterranean formation penetrated by a well. A rigid string is assembled, comprising a tubing string, at least one punch charge carrier, at least one perforating charge carrier, means for rigidly connecting the at least one,punch charge carrier and the at least one perforating charge carrier, means for detonating the at least one punch charge and the at least one perforating charge, and means for providing fluid at an overbalanced pressure in the well adjacent the interval. The at least one punch charge carrier has a wall and ends enclosing void spaces filled with a means for scouring and propping at least one fracture in the subterranean formation. At least one punch charge is mounted inside the at least one punch charge carrier. The punch charge is capable of creating an aperture in the wall of the punch charge carrier. At least one perforating explosive charge is mounted in the at least one perforating charge carrier. The perforating charge is capable of creating apertures in the wall of the perforating charge carrier, the well casing, and a portion of the adjacent interval of the formation. The tubing string is utilized to position the assembly in the well so that the at least one perforating charge carrier is adjacent the interval. A liquid is supplied under pressure to at least a portion of the well, with at least part of the portion adjacent the interval in the formation. The detonating means is utilized to detonate the at least one unlined punch charge and the at least one perforating charge, thereby releasing scouring and propping means from the at least one unlined punch charge carrier into the pressurized liquid and creating a pathway for the pressurized liquid to enter and fracture the interval of the formation.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENTS

The present invention comprises a method and apparatus for enhancing perforation and fluid production from a well penetrating a subterranean formation. The method and apparatus may also be used to enhance fluid injection into the formation.

Figure 1:
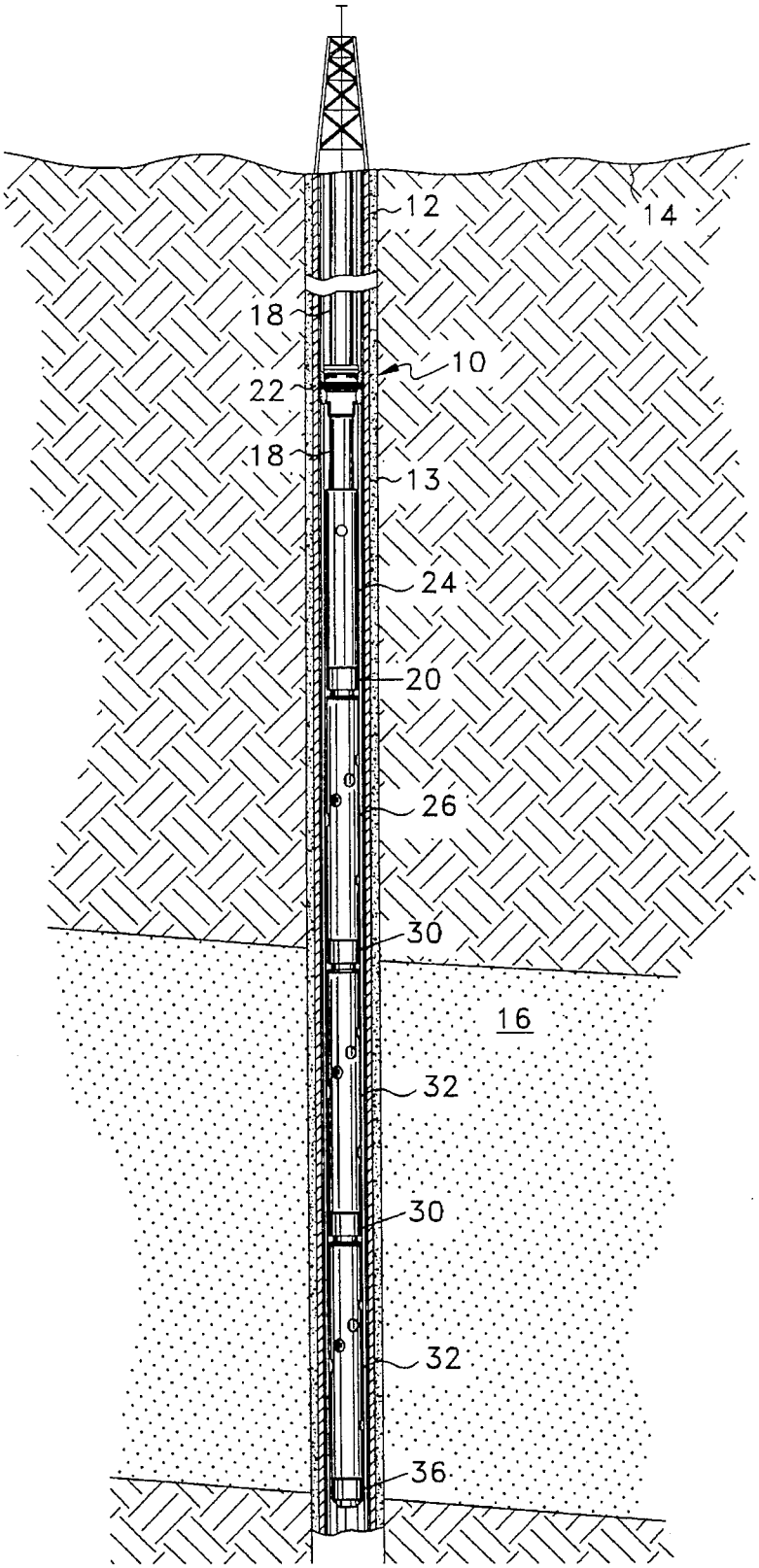
FIG. 1 is a cross section of a well penetrating a subterranean formation and the apparatus of this invention.

One embodiment of the apparatus of the present invention comprises a perforating assembly having carriers for two types of charges, for use in a cased well penetrating a subterranean formation. As shown in FIG. 1, a well 10 having a casing 12 and cement 13 extends from the surface of the earth 14 through an interval 16 in a subterranean formation. The well may be completed by any method known to those skilled in the art. A tubing string 18 supports perforating assembly 20 of the present invention inside the well 10. A means, such as a packer 22, may be used to isolate the portion of well 10 adjacent interval 16. Any suitable packer known to those skilled in the art may be used. Alternatively, a wireline could be used to support assembly 20 if no packers are present in the well above the interval to be perforated. If tubing is used, increased rigidity and strength of the tubing string will enable a longer interval to be perforated, and fractured if desired, as hereinafter discussed. Assembly 20 comprises a top sub 24, a punch charge carrier 26, tandem subs 30, perforating charge carriers 32, and bull plug 36. At least one punch charge carrier and at least one perforating charge carrier are included in the assembly. A tandem sub 30 is utilized to rigidly connect each carrier(s) to adjacent carrier(s). The assembly is utilized to perforate and hydraulically fracture or stimulate the subterranean formation.

Figure 2:
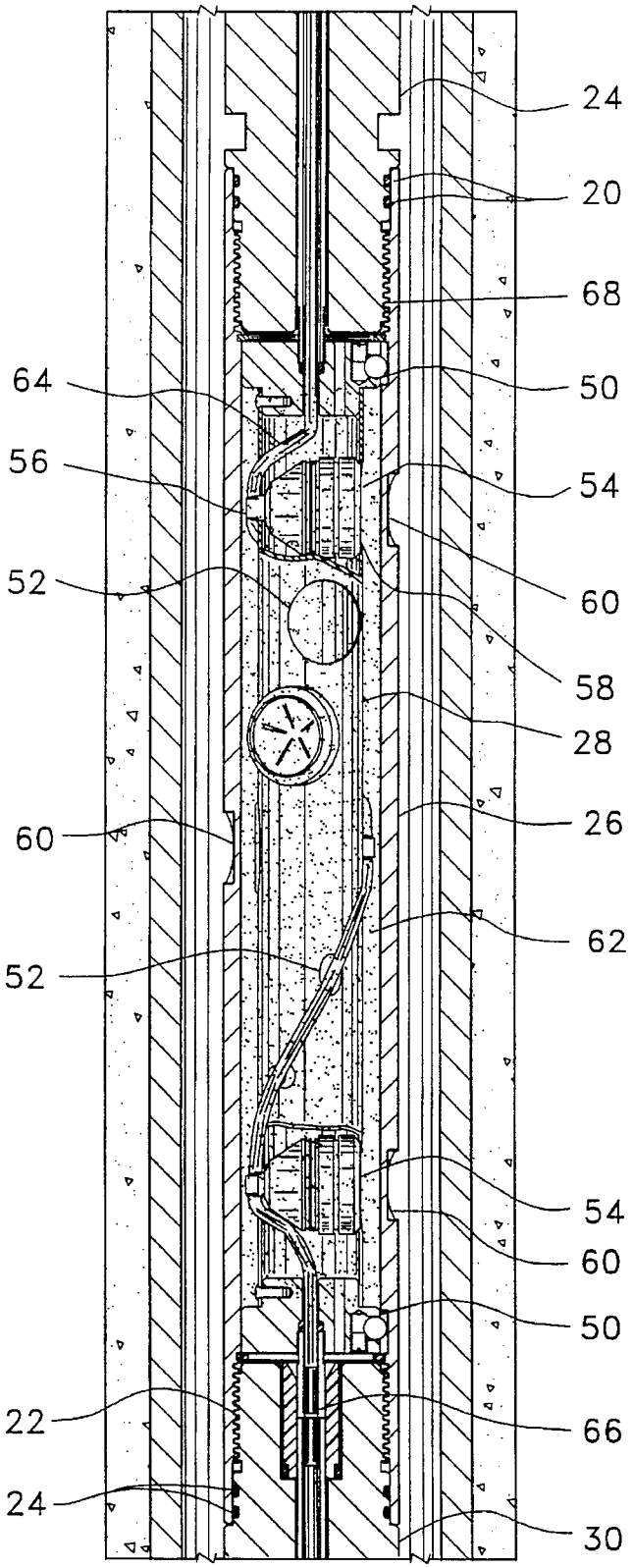
FIG. 2 is a enlarged cross section of a portion of the well and apparatus of FIG. 1, showing a unlined punch charge carrier in partial cross section.

Referring to FIG. 2, one end of punch charge carrier 26 is attached to top sub 24 by any suitable means, such as by screw threads 68. A pair of 0-rings 70 provide a fluid tight seal between carrier 26 and top sub 24. The other end of punch charge carrier 26 is attached to a tandem sub 30 by any means, such as screw threads 72 and 0-rings 74 which provide a fluid tight seal therebetween. Charge carrier 26 and punch charge tube 28 are generally tubular. Tube alignment end plates 50 function to align punch charge tube 28 within carrier 26. Punch charge tube 28 is aligned inside punch charge carrier 26 so that the large ends 58 of charges 54 are adjacent scallops 60 carved into the exterior of punch charge carrier 26. The void spaces inside punch charge carrier 26 are substantially filled during assembly with dry sand 62. As used herein, the term "sand" refers to a particulate material comprising silicate minerals, bauxite, ceramics, or another suitable material for scouring and propping hydraulic fractures. Sand may additionally comprise any other dry material, such as a propellant or a solid capable of forming an acid when dissolved in water. The propellant may form a solid matrix about the other sand particles. Upon ignition, it reacts somewhat more slowly than the at least one punch charge. As shown, openings 52 in the wall of charge tube 28 may be spaced both vertically along and angularly about the axis of the tube. Either lined or unlined punch charges may be utilized. Unlined punch charges are preferred for reasons of economy. An unlined punch charge 54 has a small end 56 secured in an opening 52 as described below, and a large end 58 protruding through opening 59. At least one unlined punch charge 54 is mounted in unlined punch charge tube 28. If multiple charges are present, their density, or number of charges per unit length of the carrier, is relatively low, such as one or two per foot. Any openings 52 and 59 which are not occupied by charges facilitate movement of sand from the carrier into the well, as described below. A detonating cord 64 is connected to a detonator above top sub 24, to the small end 56 of each punch charge 54, and to booster transfer 66 in tandem sub 30. One or more additional combinations of a punch charge carrier and a tandem sub could be mounted below carrier 26.

Figure 3:
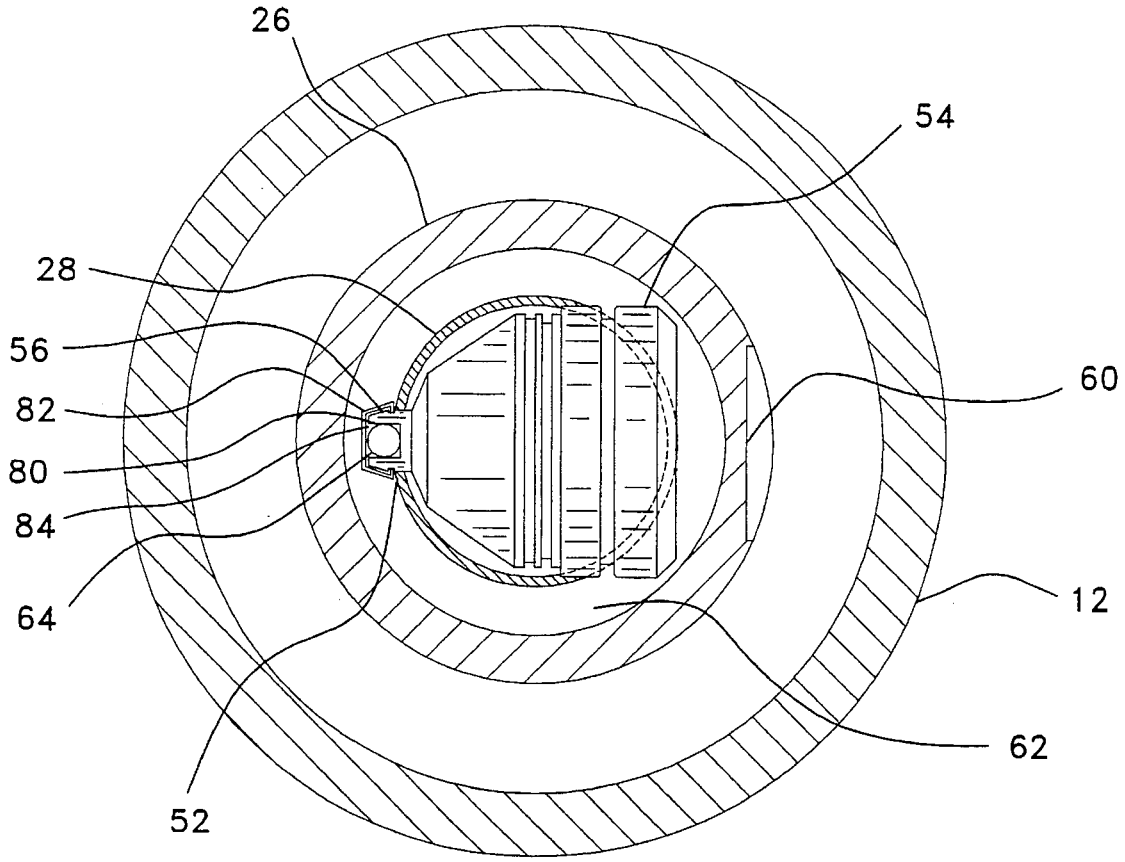
FIG. 3 is a cross section illustrating the spatial relationships between an unlined punch charge case, a carrier section, and the well casing.

Referring to FIG. 3, brackets 80 on the small end 56 of unlined punch charge 54 extend through opening 52 in charge tube 28. A clip 82 secures punch charge 54 to charge tube 28. Detonating cord 64 is threaded through a space 84 between brackets 80 and clip 82. Charge tube 28 is mounted in carrier 26 so that the large end 58 of charge 54 is adjacent scallop 60 in carrier 26. Sand 62 fills void spaces inside charge tube 28 and carrier 26.

Figure 4:
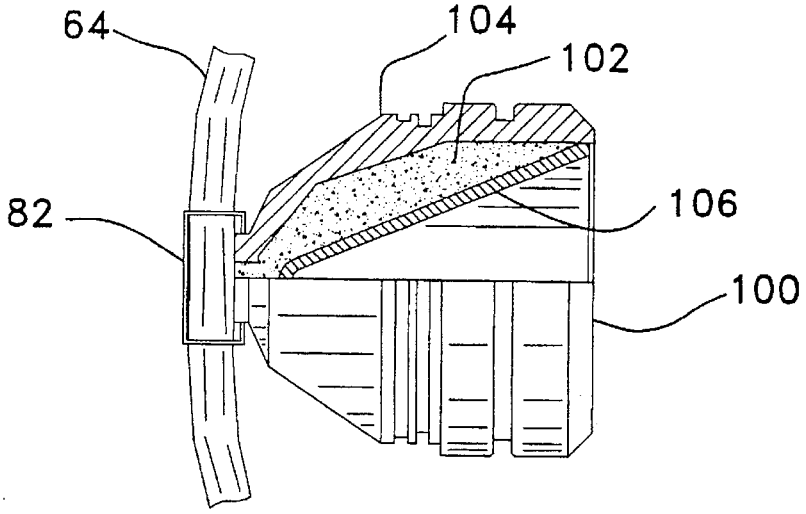
FIG. 4 is a partial cross sectional view of a perforating charge as conventionally positioned within a charge carrier.

The unlined punch charges 54 of the present invention are distinguishable from perforating charges known to those skilled in the art. Referring to FIG. 4, a typical perforating charge is shown generally by 100. A highly compressed explosive 102 partially fills perforating charge case 104. Liner 106 covers the exposed surface of the explosive. The liner 106 is commonly metallic and serves to focus the energy of the charge and enable the charge to perforate a well casing.

Figure 5:
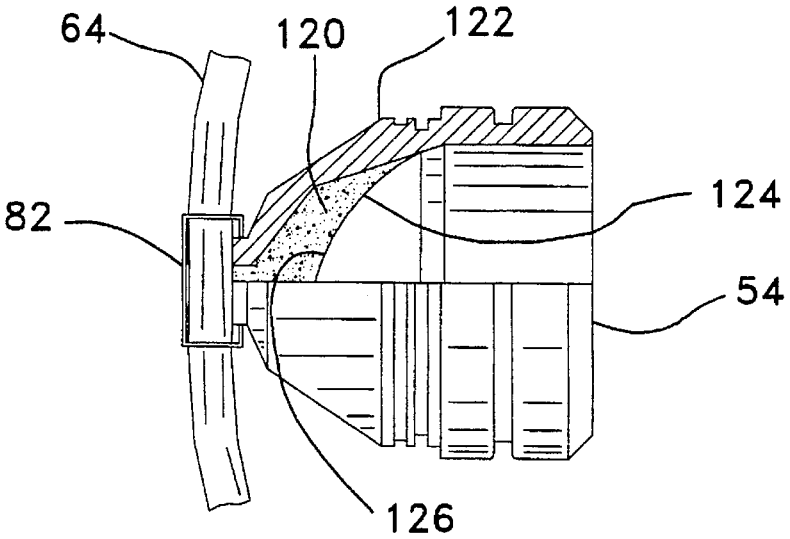
FIG. 5 is a partial cross sectional view of an unlined punch charge as utilized in the apparatus of the present invention.

An unlined punch charge 54 is shown in FIG. 5. A highly compressed explosive 120 partially fills charge case 122. Charge case 122 may have any shape known to those skilled in the art. Depending on the type of case utilized, the volume and shape of explosive 120 can be varied to achieve the desired results. In general, unlined punch charges contain less explosive than perforating charges, and they are shaped so that only the charge carrier is penetrated, while leaving the well casing intact. Unlike shaped charge 100, unlined punch charge 54 does not have a liner. In place of a liner, a thin coating 124 of an air-impermeable material may be applied to surface 126 of the explosive to prevent oxidation prior to detonation. Coating 124 can comprise paint, shellac, glue, or a similar material that does not react chemically with the explosive. The explosive composition utilized in unlined punch charge 54 is a composition known to those skilled in the art and selected to perform at the temperature encountered in the well adjacent to the interval to be perforated. Commonly used compositions include explosives of grades RDX, HMX, PS, HNS, PYX, and NONA. Optionally, a cap may be installed to prevent sand from entering the portion of the case which is not filled by the explosive. The cap may comprise any suitable material.

Figure 6:
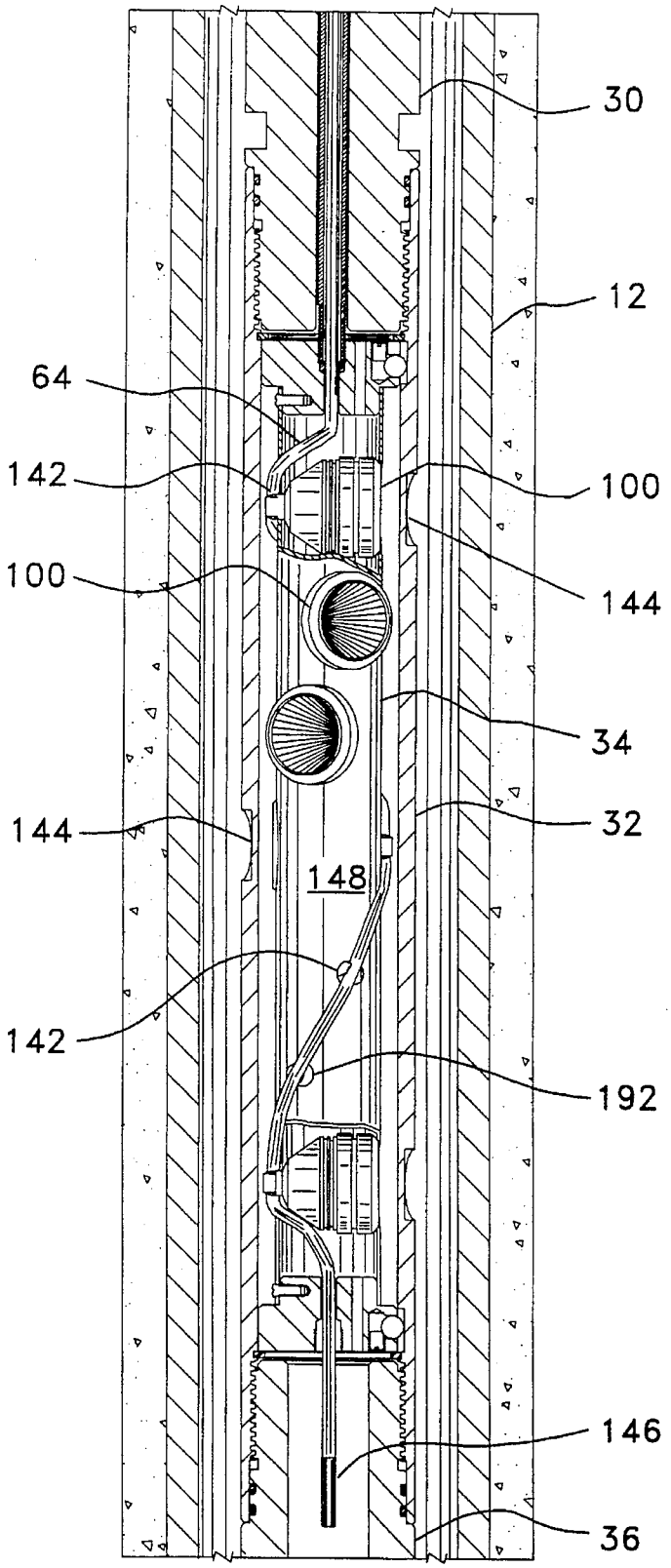
FIG. 6 is a enlarged cross section of another portion of the well and apparatus of FIG. 1, showing a perforating charge carrier in partial cross section.

As shown in FIG. 6, perforating charge carrier 32 is located between two tandem subs 30 or between a tandem sub 30 and bull plug 36. Carrier 32 may be a commercially available carrier for perforating charges and contains at least one conventional perforating charge 100 capable of creating an aperture in the carrier wall 140, well casing 12, and a portion of the interval 16 in the adjacent subterranean formation. Each perforating charge 100 is secured in an opening 142 in perforating charge tube 34 with a clip. Charge tube 34 is positioned in carrier 32 so that the front of each charge is adjacent a scallop 144 in the wall of carrier 32. If multiple charges are present, they may be spaced vertically along and angularly about the axis of the carrier. The charge density is an appropriate density determined by methods known to those skilled in the art. Common charge densities range between six and twelve per foot. Detonating cord 64 connects a booster transfer 66 in tandem sub 30 above carrier 32, all charges 100, and end cap 146 in bull plug 36. Void spaces 148 inside the carrier are generally filled with air. Alternatively, one or more combinations of an additional tandem sub and an additional perforating charge carrier could be mounted below carrier 32. The detonating cord would then be connected to a booster transfer in the tandem sub below each additional perforating charge carrier.

Figure 7:
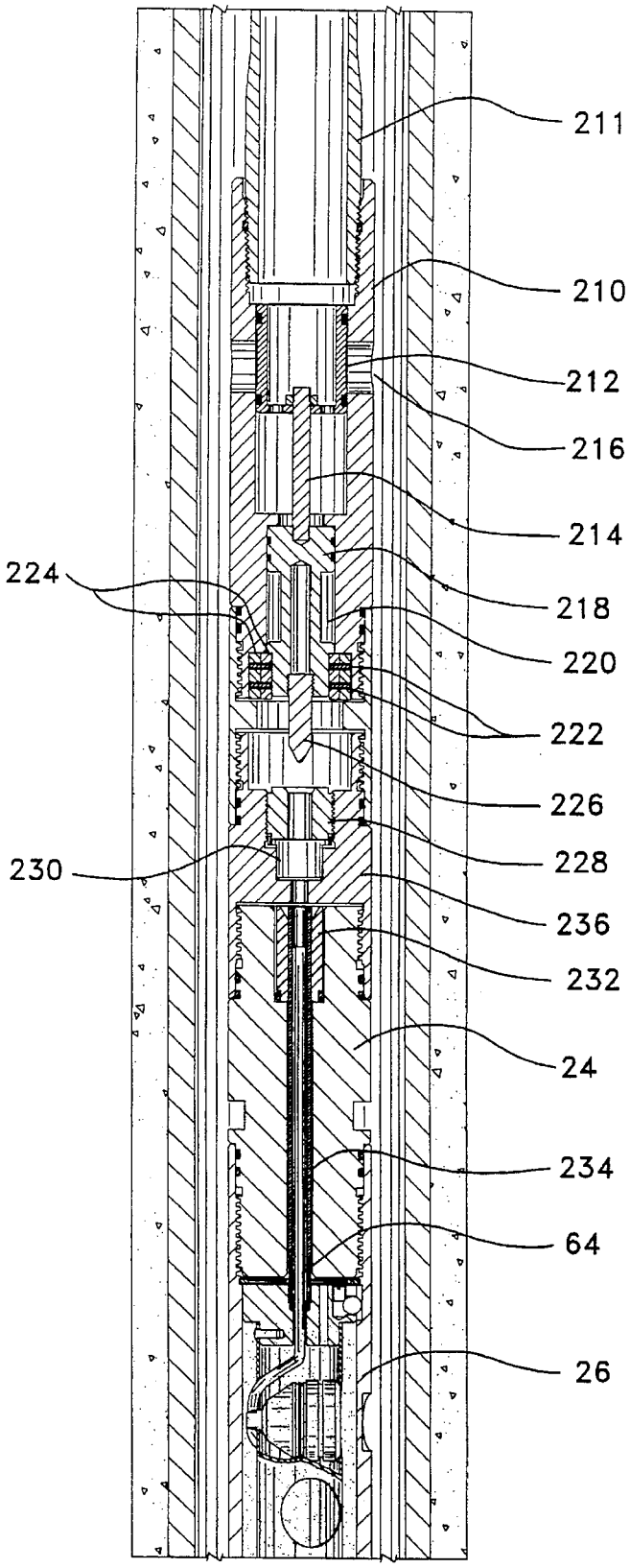
FIG. 7 is a cross section of a portion of a detonating system suitable for use in the present invention.

Any suitable detonating system known to those skilled in the art may be used. An example of a detonating system suitable for use with the apparatus of the claimed invention is shown in FIG. 7. Vent housing 210 is capable of attachment to the end of a tubing string 211 or wireline (not shown). A vent 212 is attached to connecting rod 214 inside vent housing 210 and seals fluid passage 216. Rod 214 is in contact with a piston 218. An annular chamber 220 between piston 218 and the interior wall of housing 210 is filled with air at atmospheric pressure. Adjacent the bottom of piston 218, shear pins 222 are mounted in shear set 224, and a firing pin 226 extends downward from the bottom of piston 218. Retainer 228 joins vent housing 200 and top sub 24. Percussion detonator 230 is mounted in retainer 228 in firing head 236 which is attached to vent housing 210 and capable of attachment to top sub 24. Sub 24 is attached to unlined charge carrier 26. An ignition transfer 232 at the top of sub 24 is in contact with detonating cord 64 passing through central channel 234 and charge carrier 26, as described above. A booster transfer is located in each tandem sub 30, linking the detonating cords in the charge carriers above and below the tandem sub.

Upon application of sufficient hydraulic pressure to the top of piston 218, vent 212 and piston 218 simultaneously move downward, opening fluid passage 214 and causing firing pin 226 to contact percussion detonator 230. The ignition of percussion detonator 230 causes a secondary detonation in ignition transfer 232, which in turn ignites detonating cord 64. Detonating cord 64 comprises an explosive and runs between the ends of each charge carrier, passing between the backs of charges and the charge clips holding the charges in the carrier. Cord 64 ignites the charges in charge carrier 26 and booster transfer 66, which contains a higher grade explosive than detonating cord 64.

As described above and shown in FIG. 7, an impact detonator provides a primary detonation. If the perforating assembly is run on a wireline, the primary detonator could, alternatively, be an electrical detonator. The primary detonator ignites a pressure-sensitive chemical in ignition transfer 232 which in turn ignites detonating cord 64. The detonating cord then ignites the one or more charges in the carrier simultaneously. Each transfer booster 66 also contains an explosive for detonating the cord in the adjacent carrier. The system may be detonated from the top, the bottom, or both.

The perforating gun assembly can be used in the following manner. At the surface, the desired number of punch charge carriers 26 are loaded with charges 54, sand 62, connected with a detonating means, such as detonating cord 64. The desired number of perforating charge carriers 32 are loaded with charges 100 and a detonating means. A string of carrier units separated by tandem subs 30 is assembled at the well site as the units are lowered into the well at the end of a tubing string or wireline. The assembly is then located in the well with the perforating charges adjacent the formation interval 16 to be perforated. The perforating charges 100 and the unlined punch charges 54 are then detonated.

As is apparent to one skilled in the art, if the sand comprises a propellant, an ignition means is required to ignite the propellant. Any appropriate ignition means known to those skilled in the art may be utilized. Either prior to detonation or at the time of detonation, the fluid pressure in the well is increased to an overbalanced condition, in which the fluid pressure is greater than fracture pressure of the adjacent formation. The pressure increase may be accomplished by introducing fluid and gas into the entire well. If one or more packers are utilized to isolate the interval to be perforated, the pressurized fluid may be supplied to the isolated zone of the well via the tubing and one or more ports in the tubing string.

Upon detonation, each unlined punch charge 54 blasts through a scallop 60 to create an aperture in the wall of charge carrier 26. Each perforating charge 100 blasts through a scallop 144 in carrier 32 and also creates an opening in casing 12 and penetrates interval 16 of the formation. When one or more perforating charges penetrate the formation, pressurized fluid escapes from the well and enters the perforations to hydraulically fracture the formation adjacent the perforation or perforations. As the fluid present in the well flows past the at least one punch charge carrier 26, a sand slurry forms. The fluid carries the sand into the fractures that form due to the excess fluid pressure in the well. The sand may abrade or scour the walls of the perforations and fractures, thereby enlarging the conduits for fluid flow between the formation and the well bore. Some of the sand may remain in the fractures as a proppant, thereby preventing the fractures from closing when the fluid pressure is relieved.

The rate at which sand is released from the carrier into the formation can be controlled by varying the number of perforating charges, the diameter of the holes created by the perforating charges, and/or the quantity of explosive in each perforating charge. The hole diameter is controlled by the dimensions of the perforating charges, the shape of the explosive contained in the charges, and the size of the scallop in the carrier wall. In other embodiments of the present invention, multiple intervals of a subterranean formation can be perforated and fractured in a single operation. Two or more perforating assemblies can be combined with a single tubing string. Also, a conventional perforating charge carrier can be filled with sand.

EXAMPLE

Seven-inch casing is installed in a well penetrating a formation having a pressure of approximately 5000 psi. A 4-½ inch commercial perforating carrier having a 3-¾ inch internal diameter is loaded with unlined punch charges and filled with sand containing a radioactive gamma-emitting component. The carrier is assembled above four additional commercial carriers loaded with perforating charges. The well is filled with fluid at a pressure of 14,000 psi, and the assembly is used to perforate and fracture four intervals in a well. Each interval is eight to ten feet thick, and the intervals span a vertical distance of about sixty feet. A gamma ray log of the intervals indicates that radioactive sand is present in the second and fourth intervals, counting from the top.

The perforating assembly of the present invention can be utilized with tubing or wireline. The increased strength of the tubing over wireline allows the use of a longer perforating assembly, thereby allowing a longer interval to be perforated in a single trip into a well. A tubing-conveyed assembly is compatible with the use of packers to isolate one or more portions of the well adjacent one or more intervals of the formation. Only the isolated portion or portions of the well are subjected to the overbalanced pressure required for fracturing. Thus, the method may be used where it is desired for some other reason to limit the pressure to which another portion of the well is subjected, for example, in a well where one or more other zones have already been completed. Further, if the well has a high deviation angle from vertical or is horizontal, the tubing may be used to push the perforating assembly into the well.

With the method of this invention, the fracturing and propping process occurs rapidly, with no significant pressure loss before the sand reaches the fracture or fractures. The method utilizes a relatively small amount of sand contained in the void spaces within one or more punch charge carriers and a relatively small quantity of liquid, perhaps a 1,000-foot column in a tubing string, to scour and prop the fractures effectively.

Other means can be utilized to release the sand rapidly into the well. For example, the punch charge carrier may be equipped with one or more slidable sleeves, frangible seals, or plugs closing one or more ports in the punch charge carrier. Rapid application of pressure, such by detonating one or more punch charges, can be utilized to slide the sleeves, rupture the frangible seals, or remove the plugs, thereby establishing fluid communication between the interior and the exterior of the carrier.

While the foregoing preferred embodiments of the inventions have been described and shown, it is understood that the alternatives and modifications, such as those suggested and others, may be made thereto and fall within the scope of the invention.

We claim:

1. A punch charge mounted in a charge carrier for use in a well penetrating a subterranean formation and having a casing, the charge comprising: a case containing an unlined shaped explosive, the explosive capable upon detonation of creating an aperture in a wall of the charge carrier while leaving the well casing intact.

2. The apparatus of claim 1 wherein said case additionally contains a coating over said shaped explosive.

3. The apparatus of claim 2 wherein said coating is selected from the group consisting of paint, shellac, and glue.

4. The apparatus of claim 1 wherein said explosive is selected from the group comprising explosives of grades RDX, HMX, PS, HNS, PYX, and NONA.

5. The apparatus of claim 1, further comprising means for preventing said particulate material from entering said at least one punch charge.

6. An apparatus for introducing particulate material into a cased well penetrating a subterranean formation penetrated by a well bore having casing positioned therein, the apparatus comprising:

at least one punch charge carrier having void spaces;

at least one punch charge mounted in the at least one carrier; and dry particulate material filling the void spaces within the at least one carrier; and means for detonating the at least on charge.

7. The apparatus of claim 6 wherein said particulate material is capable of scouring and propping a fracture in a subterranean formation.

8. The apparatus of claim 7 wherein said dry, particulate material is selected from the group consisting of silicate minerals, bauxite, ceramics, and mixtures thereof.

9. The apparatus of claim 7 wherein said dry, particulate material additionally comprises a solid selected from the group consisting of solids capable of forming an acid when dissolved in water, propellants, and mixtures thereof.

10. The apparatus of claim 6, further comprising means for preventing said particulate material from entering said at least one punch charge.

11. An apparatus for perforating and fracturing an interval in a cased well penetrating a subterranean formation, the apparatus comprising:

means for placing the apparatus in a well adjacent the interval to be perforated;

at least one punch charge carrier having void spaces;

means for scouring and propping at least one fracture in said subterranean formation, the means filling the void spaces in the at least one punch charge carrier;

at least one punch charge mounted in the at least one punch charge carrier;

at least one perforating charge carrier;

at least one perforating explosive charge mounted in the at least one perforating charge carrier;

at least one rigid mechanical and electrical connector for connecting all unlined punch charge carriers and all perforating charge carriers, thereby forming a rigid string of charge carriers; and means for detonating the at least one punch charge and the at least one perforating charge.

12. The apparatus of claim 11 wherein said means for placing said apparatus in said well comprises a wireline.

13. The apparatus of claim 11 wherein said means for placing said apparatus in said well comprises a tubing string.

14. The apparatus of claim 11 wherein said punch charge is unlined and comprises a case containing a shaped explosive, the explosive capable of creating upon detonation an aperture in said punch charge carrier without creating an aperture in said well casing.

15. The apparatus of claim 14 wherein said case additionally contains a coating over said shaped explosive.

16. The apparatus of claim 15 wherein said coating is selected from the group consisting of paint, shellac, and glue.

17. The apparatus of claim 11 wherein said means for scouring and propping is a dry, particulate material.

18. The apparatus of claim 17 wherein said dry, particulate material is selected from the group consisting of silicate minerals, bauxite, ceramics, and mixtures thereof.

19. The apparatus of claim 17 wherein said dry, particulate material additionally comprises a solid selected from the group consisting of solids capable of forming an acid when dissolved in water, propellants, and mixtures thereof.

20. The apparatus of claim 11 wherein a plurality of punch charges are mounted in said punch charge carrier.

21. The apparatus of claim 20 wherein said plurality of punch charges are spaced angularly about the longitudinal axis of said at least one punch charge carrier.

22. The apparatus of claim 20 wherein said plurality of punch charges are spaced vertically along the longitudinal axis of said at least one punch charge carrier.

23. The apparatus of claim 11 wherein a plurality of said carriers are joined by rigid connectors.

24. The apparatus of claim 11 wherein a plurality of perforating charges are mounted in said at least one perforating carrier.

25. The apparatus of claim 24 wherein said plurality of perforating charges are spaced angularly about the longitudinal axis of said at least one perforating carrier.

26. The apparatus of claim 24 wherein said plurality of perforating charges are spaced vertically along the longitudinal axis of said at least one perforating carrier.

27. The apparatus of claim 11 wherein said at least one punch charge carrier is above said at least one perforating carrier.

28. The apparatus of claim 11 wherein said at least one punch charge carrier is between two perforating carriers.

29. The apparatus of claim 11 wherein all punch charge carriers and all perforating charge carriers are joined in a rigid string.

30. The apparatus of claim 11 wherein said apparatus additionally comprises a means for isolating said interval in said well.

31. The apparatus of claim 30 wherein said means for isolating said interval comprises at least one packer.

32. The apparatus of claim 31 wherein said at least one packer is located above said interval in said well.

33. The apparatus of claim 11, additionally comprising means for providing fluid at an overbalanced pressure in the well adjacent the interval.

34. The apparatus of claim 33 wherein said means for providing fluid at an overbalanced pressure comprises the interior of said tubing and a port providing fluid communication between the interior of said tubing and an annulus between said tubing and said well casing below said at least one packer.

35. The apparatus of claim 11, further comprising means for preventing said particulate material from entering said at least one punch charge.

36. A method for creating fractures in an interval of a subterranean formation penetrated by a cased well, the method comprising:

(a) assembling a rigid string comprising:

a tubing string;

at least one punch charge mounted in an punch charge carrier, the carrier having void spaces filed with sand;

at least one perforating charge carrier having a wall and ends enclosing void spaces;

means for detonating the at least one punch charge and the at least one perforating charge;

(b) utilizing the tubing string to position the assembly in the well so that the at least one perforating charge carrier is adjacent the interval;

(c) supplying a liquid under pressure to at least a portion of the well, at least part of the portion adjacent the interval in the formation;

(d) utilizing the detonating means to detonate the at least one punch charge and the at least one perforating charge, thereby releasing sand from the at least one punch charge carrier into the pressurized liquid and creating a pathway for the pressurized liquid to enter and fracture the interval of the formation.

37. The method of claim 36, whereby said liquid is supplied simultaneously with detonation of said at least one perforating charge.

38. The method of claim 36, whereby said liquid is supplied prior to detonation of said at least one perforating charge.

39. The method of claim 36 wherein said punch charge is unlined and comprises a case containing a shaped explosive the explosive capable of creating upon detonation an aperture in said punch charge carrier while leaving said well casing intact.

40. The method of claim 39 wherein said case additionally contains a coating over said shaped explosive.

41. The method of claim 40 wherein said coating is selected from the group consisting of paint, shellac, and glue.

42. The method of claim 36 wherein said explosive is selected from the group consisting of explosives of grades RDX, HMX, PS, HNS, PYX and NONA.

43. The method of claim 36 wherein said sand is selected from the group comprising silicate minerals, bauxite, ceramics, or mixtures thereof.

44. The method of claim 43 wherein said dry, particulate material additionally comprises a solid selected from the group consisting of solids capable of forming an acid when dissolved in water, propellants, and mixtures thereof.

45. The method of claim 36 wherein a plurality of punch charges are mounted in said punch charge carrier.

46. The method of claim 45 wherein said plurality of punch charges are spaced angularly about the longitudinal axis of said at least one punch charge carrier.

47. The method of claim 45 wherein said plurality of punch charges are spaced vertically along the longitudinal axis of said at least one punch charge carrier.

48. The method of claim 36 wherein a plurality of perforating charges are mounted in said perforating carrier, each perforating charge capable of creating an aperture in the wall of the at least 1 perforating charge carrier, said well casing, and a portion of an adjacent interval of said formation.

49. The method of claim 48 wherein said plurality of perforating charges are spaced angularly about the longitudinal axis of said at least one perforating carrier.

50. The method of claim 48 wherein said plurality of perforating charges are spaced vertically along the longitudinal axis of said at least one perforating carrier.

51. The method of claim 36 wherein said at least one punch charge carrier is above said at least one perforating carrier.

52. The method of claim 36 wherein at least one punch charge carrier is between two perforating carriers.

53. The method of claim 36 wherein said apparatus additionally comprises a means for isolating said interval in said well.

54. The method of claim 53, wherein said means for isolating said interval comprises at least one packer.

55. The method of claim 54 wherein said at least one packer is located above said interval in said well.

56. The method of claim 36 wherein said means for providing fluid at an overbalanced pressure comprises the interior of said tubing and a port providing fluid communication between the interior of said tubing and an annulus between said tubing and said well casing below said at least one packer.

57. The method of claim 36, wherein said rigid string further comprises means for preventing said sand from entering said at least one punch charge.

58. An apparatus for introducing particulate material into a well penetrating a subterranean formation, the well having a casing positioned therein, the apparatus comprising:

at least one punch charge carrier having void spaces;

at least one punch charge mounted in the at least one carrier, the punch charge comprising a case containing an unlined shaped explosive, the charge capable of creating an aperture in said punch charge carrier without creating an aperture in said casing;

particulate material filling the void spaces within the at least one carrier; and means for detonating the at least one charge.

59. The apparatus of claim 58 wherein said case additionally contains a coating over said shaped explosive.

60. The apparatus of claim 59 wherein said coating is selected from the group consisting of paint, shellac, and glue.

61. The apparatus of claim 58 wherein said explosive is selected from the group consisting of grades RDX, HMX, PS, HNS, PYX and NONA.

62. An apparatus for introducing particulate material into a well penetrating a subterranean formation, the well having a casing positioned therein, the apparatus comprising:

at least one punch charge carrier having void spaces;

a plurality of punch charges mounted in the at least one carrier;

particulate material filling the void spaces within the at least one carrier; and means for detonating the at least one charge.

63. The apparatus of claim 62 wherein said plurality of punch charges are spaced angularly about the longitudinal axis of said at least one punch charge carrier.

64. The apparatus of claim 62 wherein said plurality of punch charges are spaced vertically along the longitudinal axis of said at least one punch charge carrier.

65. An apparatus for introducing particulate material into a well penetrating a subterranean formation, the well having a casing positioned therein, the apparatus comprising:

a plurality of punch charge carriers having void spaces, the carriers joined by rigid connectors;

at least one punch charge mounted in the at least one carrier;

particulate material filling the void spaces within the at least one carrier; and means for detonating the at least one charge.

* * * * *

UNITED STATES PATENT AND TRADEMARK OFFICE

CERTIFICATE OF CORRECTION

PATENT NO. : 5,598,891
DATED : February 4, 1997
INVENTOR(S) : Philip M. Snider et al.

It is certified that error appears in the above-identified patent and that said Letters Patent is hereby corrected as shown below:

Column 3,
Line 38, following "one" delete "," and insert a space.

Column 4,
Line 58, delete "0" and insert -- O --.
Line 61, delete "0" and insert -- O --.

Column 9,
Line 8, delete "on" and insert -- one --.

Column 10,
Line 48, delete "an" and insert -- a --.

Column 11,
Line 22, delete "or" and insert -- and --.
Line 55, following "53" delete ",".

Column 12,
Line 52, delete "the at least one carrier;" and insert -- each of said plurality of punch charge carriers; --.
Line 54, delete "the at least one" and insert -- said each --.
Line 56, delete "the at least one" and insert -- said at least one such --.
Line 57, insert the following claims:

66. The apparatus of claim 6 wherein said at least one punch charge carrier has at least one port and additionally comprises means for closing the at least one port, the means capable of motion upon rapid application of pressure, thereby establishing fluid communication between the interior and the exterior of each punch charge carrier.

67. The apparatus of claim 11 wherein said at least one punch charge carrier has at least one port and additionally comprises means for closing the at least one port, the means capable of motion upon rapid application of pressure, thereby establishing fluid communication between the interior and the exterior of each punch charge carrier.

UNITED STATES PATENT AND TRADEMARK OFFICE

CERTIFICATE OF CORRECTION

PATENT NO. : 5,598,891
DATED : February 4, 1997
INVENTOR(S) : Philip M. Snider et al.

It is certified that error appears in the above-identified patent and that said Letters Patent is hereby corrected as shown below:

68. The apparatus of claim 36 wherein punch charge carrier has at least one port and additionally comprises means for closing the at least one port, the means capable of motion upon rapid application of pressure, thereby establishing fluid communication between the interior and the exterior of the punch charge carrier.

69. The apparatus of claim 58 wherein at least one punch charge carrier has at least one port and additionally comprises means for closing the at least one port, the means capable of motion upon rapid application of pressure, thereby establishing fluid communication between the interior and the exterior of each punch charge carrier.

70. The apparatus of claim 62 wherein said at least one punch charge carrier has at least one port and additionally comprises means for closing the at least one port, the means capable of motion upon rapid application of pressure, thereby establishing fluid communication between the interior and the exterior of each punch charge carrier.

71. The appratus of claim 65 wherein at least one of said punch charge carriers has at least one port and additionally comprises means for closing the at least one port, the means capable of motion upon rapid application of pressure, thereby establishing fluid communication between the interior and the exterior of the punch charge carrier.

Signed and Sealed this

First Day of January, 2002

*Attest:*

*Attesting Officer*

JAMES E. ROGAN
*Director of the United States Patent and Trademark Office*